United States Patent [19]

Gunther

[11] 3,979,636

[45] Sept. 7, 1976

[54] CHARGED PARTICLE BEAM SCANNING DEVICE

[75] Inventor: John E. Gunther, Lavon, Tex.

[73] Assignee: Texas Instruments Incorporated, Dallas, Tex.

[22] Filed: Nov. 21, 1974

[21] Appl. No.: 526,032

[52] U.S. Cl. ..... 315/12 R; 313/409

[51] Int. Cl.[2] ..... H01J 29/41

[58] Field of Search ..... 315/12 ND, 31 R, 11, 315/12, 365, 366, 31 FT; 340/324 M; 313/470–473, 409, 410, 411, 500, 510, 495

[56] References Cited

UNITED STATES PATENTS

| | | | |
|---|---|---|---|
| 3,740,603 | 6/1973 | Kuhn | 313/410 |
| 3,742,276 | 6/1973 | Gumpertz | 313/410 |
| 3,769,540 | 10/1973 | Thomson | 315/12 |
| 3,803,443 | 4/1974 | Hant | 315/12 |

*Primary Examiner*—T.H. Tubbesing
*Assistant Examiner*—T. M. Blum
*Attorney, Agent, or Firm*—Harold Levine; James T. Comfort; Richard L. Donaldson

[57] ABSTRACT

A plurality of control plates is sandwiched between a cathode and a target to control the flow of charged particles such as electrons and ions between the cathode and the target. The cathode includes an elongated filament for generating charged particles such as electrons. A first electrode is positioned behind the filament with a second electrode having a positive potential interdigitated with the first electrode. The first electrode is divided into segments with a negative potential applied to those segments of first electrode where emission is desired from the elongated filament, and in those areas where emission is not desired those segments of the first electrode are switched sufficiently negative to cut off emission from the elongated filament. Each control plate has a plurality of apertures formed therein which are effectively aligned with corresponding apertures on the other control plates. The aligned apertures form beam channels. The control plates have paired conductive electrodes thereon arranged at predetermined coded finger patterns. Voltages are selectively applied to the control plate electrodes by switching circuitry to focus the charged particles through the apertures associated with selective electrodes while simultaneously aborting the passage of charged particles through the apertures associated with the remaining electrodes. In this manner by selective switching control of the control plate a beam, or a plurality of beams, can be directed to a selected portion or portions of the target at the time.

13 Claims, 8 Drawing Figures

CHARGED PARTICLE BEAM SCANNING DEVICE

This invention is directed to a charged particle beam scanning device and more particularly to such a device which is responsive to a digital control signal.

Another charged particle beam scanning device is disclosed in U.S. Pat. No. 3,803,443. In such a device, a plurality of control plate are sandwiched between a cathode and a target to control the flow of charged particles such as electrons and ions between the cathode and the target. Each control plate has a plurality of apertures formed therein which are effectively aligned with corresponding apertures on the other control plates. The aligned apertures form beam channels. Control plates have paired conductive electrodes thereon arranged in predetermined coded finger patterns. Voltages are selectively applied to the control plate electrodes by means of switching circuitry to electrostatically focus the charged particles through the apertures associated with selected electrodes while simultaneously aborting the passage of charged particles through the apertures associated with the remaining electrodes. In this manner by selective switching control of the control plate, a beam or plurality of beams can be directed to a selected portion or portions of the target at a time. In another embodiment of an electron scanning device, such as that described in U.S. Pat. No. 3,408,532 flat dynode control plates are used in place of the electrostatic focusing with the flat dynode control plates sandwiched between a flat cathode and a flat target plate. In the device using the dynode control plates, the dynode control plates perform both control and electron multiplication functions. Such scanning devices are those described, have distinct advantages over cathode ray tube scanning devices of the prior art because of their compact configuration, high linearity and capability of response to randomly addressed digital control signals.

Such charged particle beam scanning devices have previously required large voltage swings on the control plates. Voltages required on the control, or switching plates as they may be termed, must be a high potential (typically 75 to 100 volts above the potential of the cathode). These high potentials are required for several reasons. Previous cathode designs such as that disclosed in U.S. Pat. No. 3,769,540 have required high current so that the cathode will emit electrons with good uniformity at the first switching plate. There must also be a sufficient current density of the electrons to permit a bright display on the phospor screen. This requires significantly high voltage between the cathode and the first switching plate to achieve both uniformity and a sufficiently bright display. When the current flood from the area cathode arrives at the first switching plate of the switching stack there is an attenuation of the electrons due to the geometrical shadowing effect on the switching plate. Electrons striking the holes go through the holes while those striking the area on the switching plate between the holes do not go through the holes. Previous designs of the charged particle beam scanning device has attacked the attenuation problem by putting a much higher potential on the second switching plate when the on condition is desired. This very high potential on the second switching plate will cause equipotential lines in front of the first switching plate to bulge out and form a positive electrostatic lens. This will draw in electrons which would have struck the periphery of the first switching plate holes and draw the electrons into and through the holes instead of allowing them to be lost when they strick the periphery around the holes. The problem in providing such a high potential is that so much kinetic energy is imparted to the electrons that very large voltage swings are required to turn them off. If an electron passes through any hole in the switching stack with a large value of electron volts of kinetic energy, then reduction by at least the same amount of electron volts is required to subsequently turn the electron flow off. Thus there is a necessarily high voltage swing in the switching plates to achieve a sufficiently bright display.

A charged particle beam scanning device which provides for lower switching voltages at the switching plates, uniform charge density of emitted electrons and decreased cathode power requirements is shown in copending patent application Ser. No. 463,934, filed Apr. 25, 1974, assigned to Texas Instruments.

It is an object of this invention to provide a new and improved charged particle beam scanning device.

Another object of this invention is to provide a new and improved charged particle beam scanning device having improved control of emission from the cathode.

Figure 2:
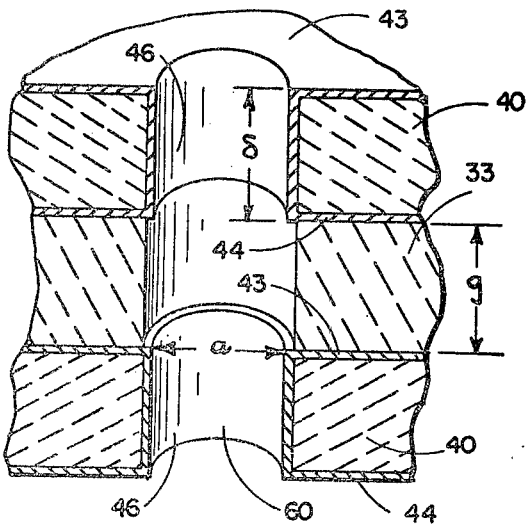
FIG. 2 is a cross-sectional view illustrating the construction of the embodiment shown in FIG. 1.
Figure 3:
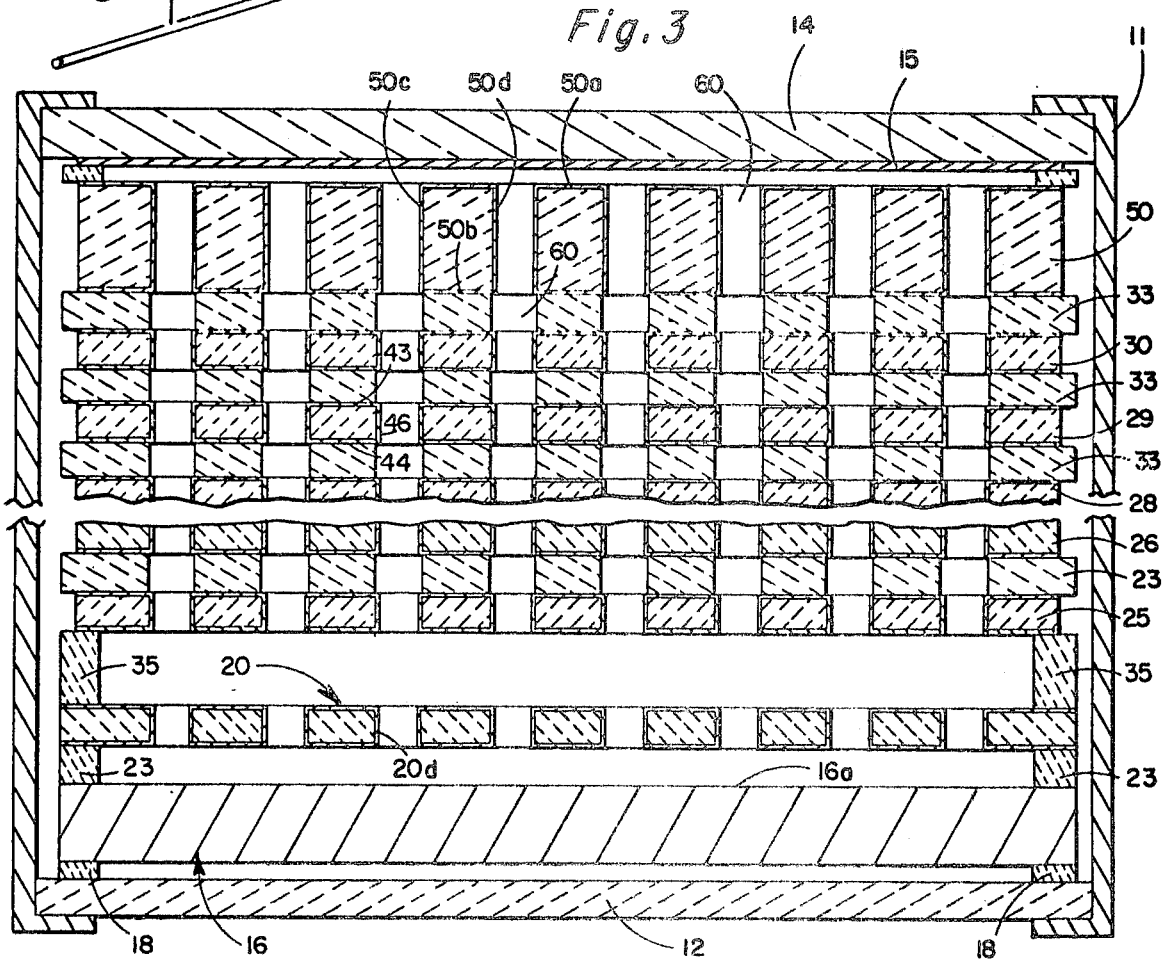
FIG. 3 is a cross-sectional view showing details of the electron beam channels of the embodiment of FIGS. 1 and 2.

Referring now to FIGS. 2 and 3, cross-sectional views illustrating the structure of one embodiment of the device of the invention are shown. It is to be noted that for illustrative purposes, an 8×8 display is shown, but that in most practical implementations, a much greater number of channels would be utilized to provide a much higher definition display. A vacuum tight casing is formed by means of side frame member 11, ceramic plate 12, and glass front viewing plate 14. The casing so formed is evacuated so as to provide a vacuum environment for the components contained therein.

Figure 4:
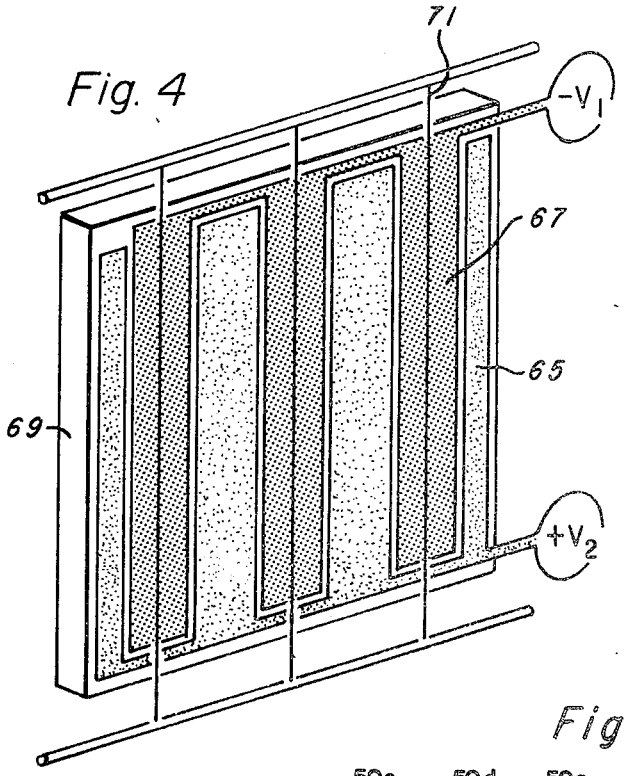
FIG. 4 shows the area cathode of the embodiment in more detail.

Cathode 16, which is shown in FIG. 4 in more detail, is supported along opposite edges thereof on bar members 18. Mounted directly opposite cathode 16 is input buffer plate 20, which is formed from solid metal such as a nickle-iron alloy. Input buffer plate 20 is separated from cathode 16 by means of insulator bars 23.

Figure 1:
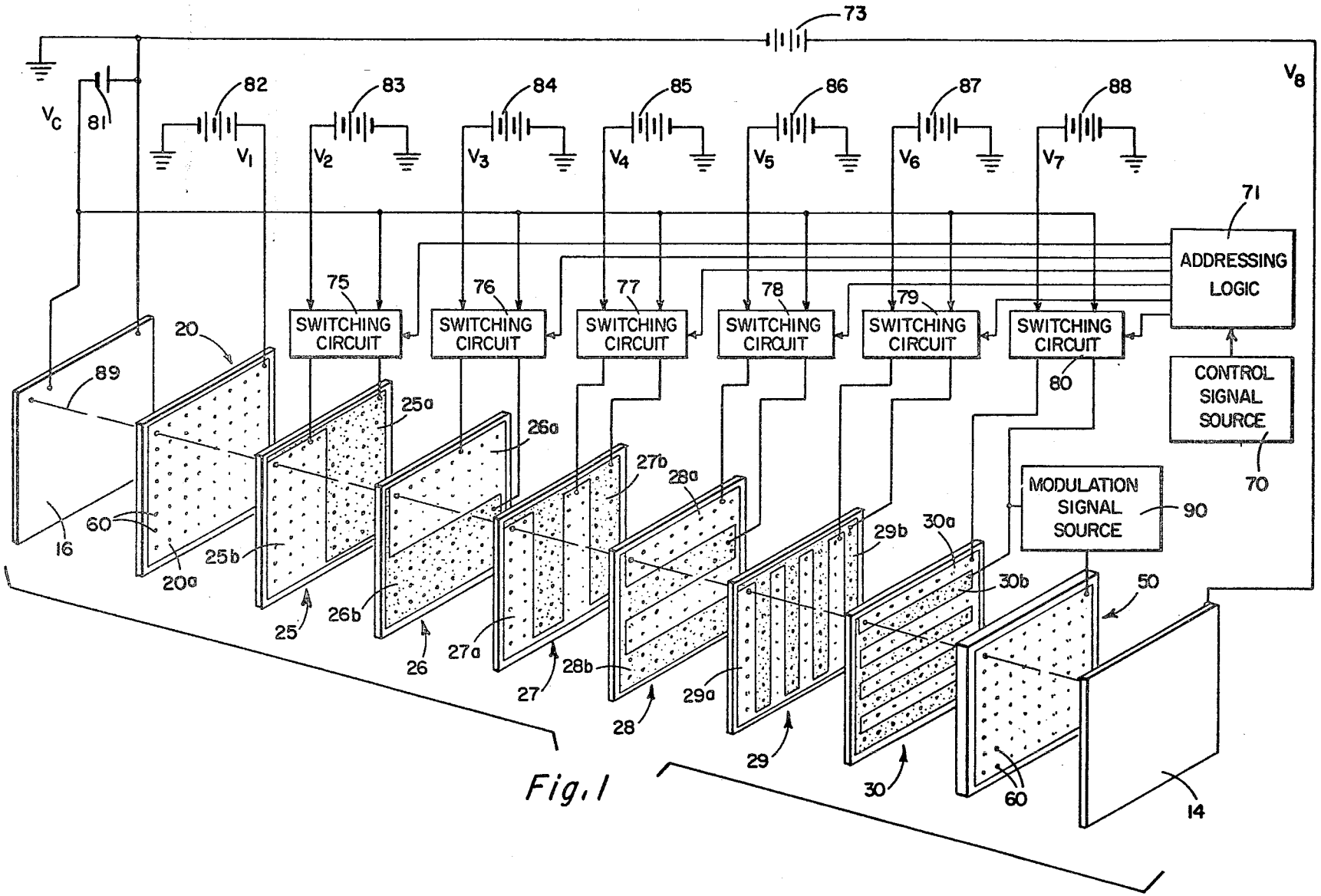
FIG. 1 is a schematic drawing of one embodiment of a charged particle beam scanning device.

Next in the stack are control or switching plates 25–30, which are insulatively separated from each other by means of insulator plates 33 which may be of a ceramic material. Plate 25 is separated from lens plate 20 by means of insulator spacer bars 35. As can best be seen in FIG. 2, the control plates are formed of a dielectric substrate 40 which may be of a material such as ceramic or glass, having similar electrodes 43 and 44 of a highly conductive material such as gold or copper deposited on the opposite surfaces thereof. The electrodes are arranged in predetermined finger patterns, as illustrated in FIG. 1, with the opposite electrodes 43 and 44 of each control plate having the same finger pattern arranged opposite each other in mirror image relationship. Electrodes 43 and 44 are electrically interconnected by means of coatings 46 which are deposited on the walls of the apertures extending between the opposite sides of the plates.

Mounted above control plate 30 and separated therefrom by an insulator plate 33 is modulator plate 50. Modulator plate 50 is similar in general construction to the control plates in that it includes electrodes 50*a* and 50*b* of a highly conductive material such as gold or copper on the opposite surfaces thereof, which are interconnected by conductive portions 50*c* deposited on the walls of the apertures of the plates, the conductive layers 50*a*–50*c* being deposited on dielectric substrate 50*d*. Modulator plate 50, however, differs from the control plates in that the electrodes 50*a* and 50*b* are not arranged in a finger pattern but are rather deposited over the entire surface areas of the plate. Also, in the modulator plate, as can be noted in the drawing, the length of the apertures is substantially greater than that of the control plate, the choice of length to diameter ratio being designed to provide less abrupt cut-off characteristics to facilitate the handling of a modulation signal.

All of the various plates just described have a plurality of apertures 60 formed therein, corresponding apertures of successive plates being aligned with each other to form electron beam channels between cathode 16 and phosphor target 15 on plate 14.

Input buffer plate 20 and modulator plate 50 are not essential for the basic operation of the device, and an electron beam can be addressed to the target from the cathode in response to digital control signals without these particular plates. However, each one affords a special function which may be needed for a particular application requirement. Thus, the modulator plate 59 enables the intensity modulation of the beam where this may be called for, while the input buffer plate provides for increased input current which will contribute to higher intensity of the display.

Referring now to FIG. 1, the device of the invention is schematically illustrated. Each of control plates 25–30 has a pair of electrodes 25*a*, 25*b* – 30*a*, 30*b*, on each of the opposite surfaces thereof. Thus, the electrodes on the opposite surfaces which are not shown are mirror images of the electrodes which are shown in the Figure. The electrodes are of a highly conductive material such as gold or copper, and each electrode 25*a*–30*a* is electrically insulated from its paired electrode 25*b*–30*b* respectively. As already explained in connection with FIGS. 2 and 3, the electrodes on opposite surfaces are electrically interconnected with each other by means of conductive coatings which may be of the same material as the electrodes on the walls of the apertures extending therebetween.

Digital control signals are fed from control signal source 70 to addressing logic 71 which provides an appropriate control signal to each of switching circuits 75–80. Switching circuits 75–80 may be electronic switching circuits such as flipflops, capable of alternatively connecting the voltages fed thereto to either one or the other of the paired electrodes of the particular control plate associated therewith in response to the addressing logic. Voltages are applied to switching circuits 75–80 for use in controlling the electrodes from power sources 83–88 respectively. A beam accelerating voltage is applied between cathode 16 and target 14 from voltage source 73. Switching circuits 75–80 receive first voltages $V_2$–$V_7$ from power sources 83–88 respectively, which are positive voltage with respect to ground, and a second voltage, $V_c$, which is a negative voltage with respect to ground.

The switching circuits in response to addressing logic 71 alternatively connect $V_2$–$V_7$ as the case may be, to one of the paired electrodes of each control plate and $V_c$ to the other paired electrode. For illustrative purposes, all of the electrodes receiving the voltage $V_c$ are shown stippled, while those receiving $V_2$–$V_7$ are shown without stippling. Under such conditions a beam of electrons are indicated by line 89 will pass through only a single channel formed by the plate apertures, the flow of electrons being blocked through all other channels by virtue of the effect of a cut-off voltage $V_c$, appearing somewhere in each of these other channels.

Thus, by selective switching control of plates 25–30, the electron beam can be controlled so that it excites a single elemental portion of target 14 at a time. The control is effected by virtue of the electrostatic focusing, achieved by means of the electron lenses formed between electrode portions of successive plates having the potentials $V_2$–$V_7$ applied thereto. The channels associated with the electrodes having the voltage $V_c$ applied thereto are cut off, the electrons being repelled in these channels and drawn off by the electrodes.

The target 14 is scanned according to the application for which the tube is used. The scanning is called out by the control signal source 70 signals to the addressing logic 71 selecting the switching plates 25–30 to control the electron beam according to the desired scanning desired.

For instance, the scanning for TV applications may be left to right and from the top to bottom of the target 14.

The electron emission from the cathode is controlled according to the scanning of the target 14. This controlled emission from the cathode 16 is described more fully with the description of cathode 16.

Input plate 20, which is utilized to increase the current, is generally similar in construction to control plates 25–30, except that it is constructed from solid metal. Voltage $V_1$ is applied to the input buffer plate 20. Modulation plate 50 may be used to intensity modulate the signal in response to a modulation signal source 90. Modulation plate 50 is generally similar in construction to control plates 25–30, having similar electrodes on each of the opposite broad surfaces thereof, with conductive coatings on the walls of aperture 60 electrically interconnecting said surface. Modulation plate 50, however, is generally designed with a substantially greater thickness so that it has longer aperture than the control plates so as to provide less abrupt cut-off characteristics to suitably accommodate modulation signals having a reasonable dynamic range.

It is to be noted that while the device of the invention has been described in connection with the control of an electron beam, it can be utilized to equal advantage in the control of beams formed from other types of charged particles such as positive or negative ions.

The area cathode 16 is shown in more detail in FIG. 4. Two interdigitated electrodes 65 and 67 are formed on the back plate 69. Electrode 67 is connected to a negative potential and electrode 65 is connected to a positive potential. A plurality of filament wires 71 are suspended in front of the area cathode 16 with each filament wire 71 positioned in front of the electrode 67 having a negative potential. The filament wires 71 are connected to a ground potential power source to heat the filament wires 71 to cause emission of electrons therefrom. Electrodes 65 and 67 may be evaporated directly on the back-plate 69, and insulated from each other.

When the filament wires are heated electrons are emitted towards the lens plate 20. The electrons are uniformly emitted with sufficient current density towards the lens plate to provide good brightness.

In FIG. 4 only 3 filament wires are shown. The area cathode actually has a plurality of filament wires, with each filament wire positioned in front one finger of electrode 67.

The forward and sideways electric fields from the electrodes 65 and 67 in the vicinity of the filament wires 71 achieves a forward and spreading set of electron trajectories from the filament wires.

There is little or no electron emission in the backward direction toward the plate 69 so that the power required for the area cathode is reduced. There is sufficient uniformity of current density of the emitted electrons to allow the distance from the filament wires to the lens plate to be small. This also reduces required cathode power. There is also sufficient forward current density at the first switching plate 25 so that the potential applied to that switching plate 25 may be relatively small as contrasted with previous designs.

The area cathode 16 is broadly an area source of charged particles. The charged particles may be other than electrons such as positive or negative ions. When charged particles other than electrons are emitted, an elongated source of such particles should be used instead of the filament wires.

Figure 5:
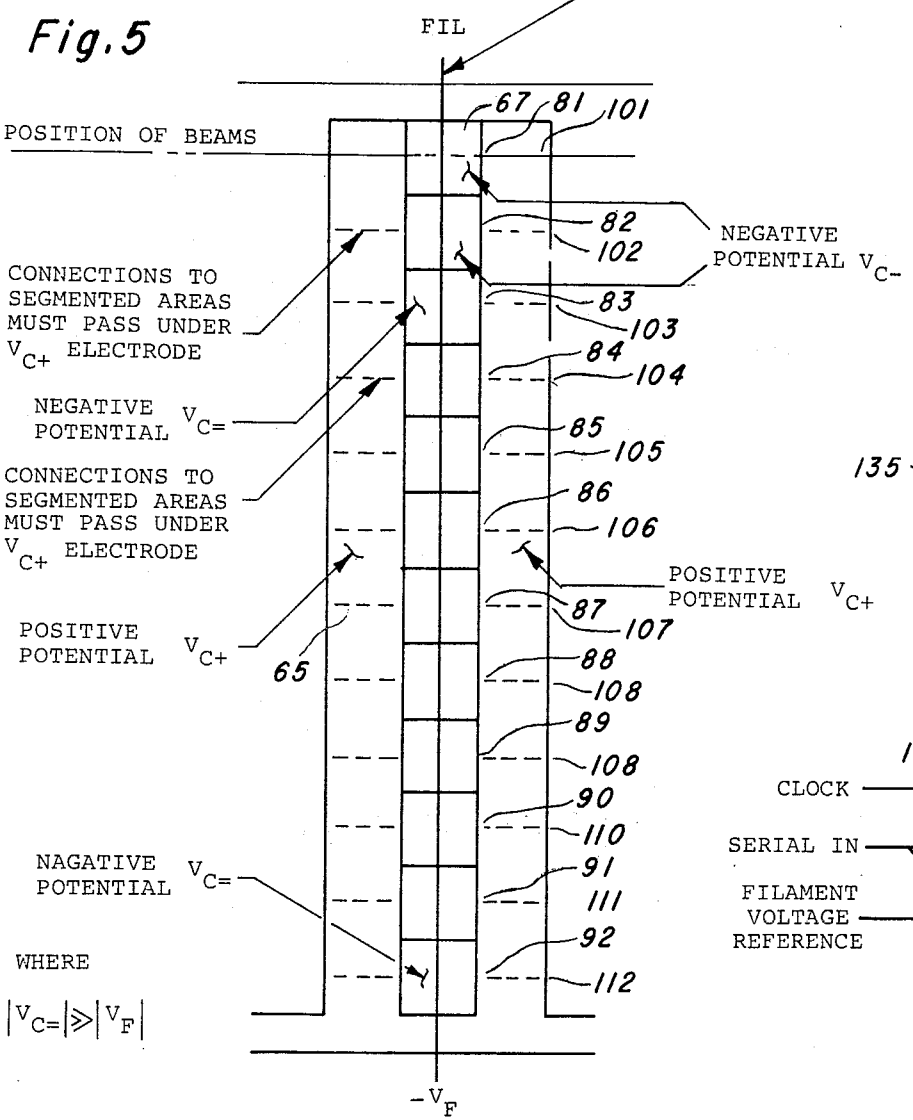
FIG. 5 shows the cathode electrodes in more detail.

Each finger of electrode 67 connected to a negative potential is segmented into a number of segments 81–92 electrically insulated from each other as shown in FIG. 5. The filament wire 71 is suspended in front of the electrode 67 and connected to a power source. Thus the interconnected segments 81–92 run perpendicular to the filament wires 71. The corresponding segments of each finger of electrode 67 are connected together in series with interconnections 101–112 passing under the fingers of electrode 65.

Figure 6:
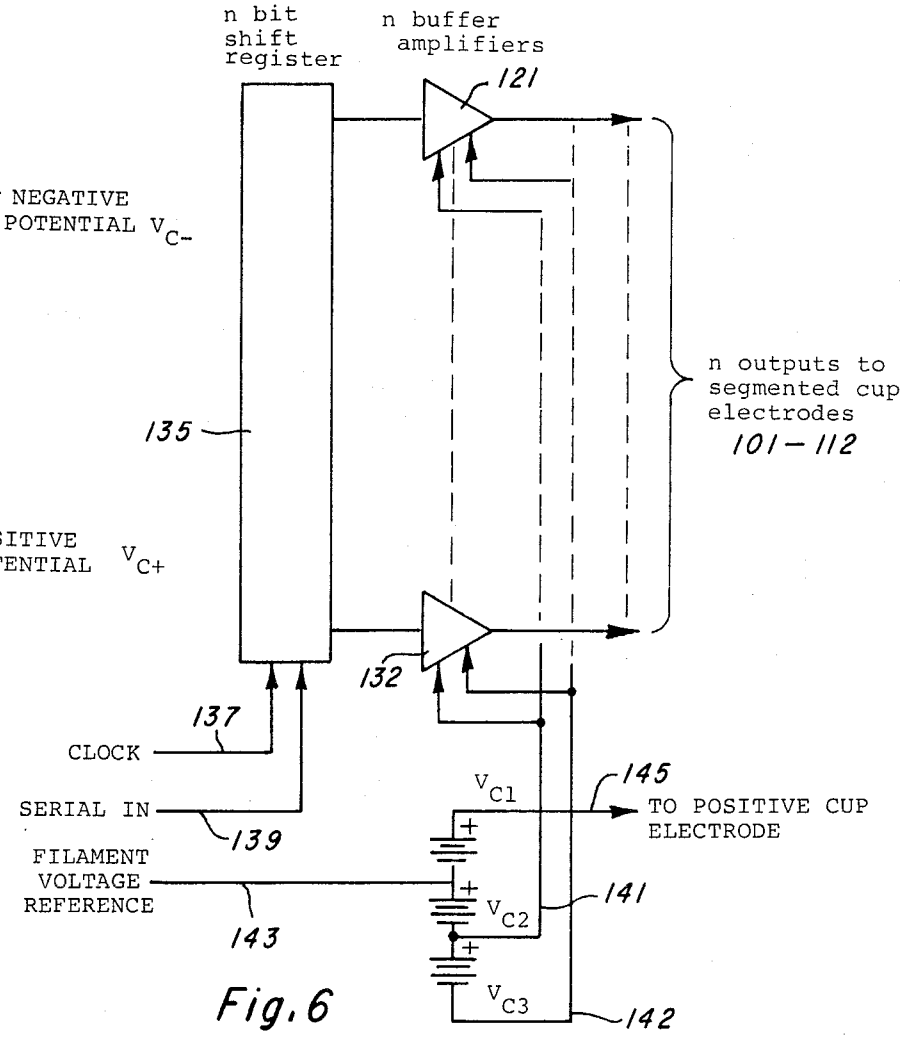
FIG. 6 shows the control circuitry for the cathode electrodes.

The interconnections 101–112 are fed out of the envelope and are connected to cathode logic shown in FIG. 6. The interconnections 101–112 are connected to a plurality of buffer amplifiers 121–132, with each interconnection 101–112 connected to a buffer amplifier 121–132. In FIG. 6 only buffer applifiers 121 and 132 are shown with the others represented by a dotted line. Each buffer amplifier 121–132 has an enabling input connected to one stage of a twelve stage shift register 135. The shift register 135 has a first clock input 137 and a serial frame input 139. These inputs 137 and 139 are from control signal source as shown in FIG. 1. Each buffer amplifier 121–132 is connected to the negative first potential $V_{C2}$ 141 and a second negative potential $V_{C3}$ 142. The first and second voltage potentials 141 and 142 are both negative with respect to the filament voltage reference 143 and the positive voltage potential $V_{C1}$ 145 supplied to the positive cathode electrode 65.

Figure 8:
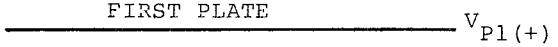
FIGS. 7 and 8 show the effect on emission from the cathode of the potentials applied to the segments of the negative electrode of cathode.
Figure 7:
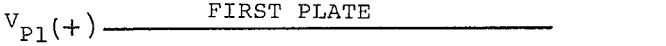

The buffer amplifiers 121–132 normally apply negative potential $V_{C3}$ to each segment 81–92 of the negative electrode 67. The application of negative potential $V_{C3}$ to a segment 101–112 cuts off emission from that portion of the filament wire 71 as shown in FIG. 7. The application of negative potential $V_{C2}$ as shown in FIG. 8 causing emission from filament wire 71.

When frame input signal is shifted into a shift register stage in shift register 135, the corresponding buffer amplifier 121–132 is enabled to apply negative potential $V_{C2}$ to be applied to the corresponding segment 101–112 instead of negative potential $V_{C3}$, causing emission from the filament wire 71 in front of that segment. Normally two or more of the segments 101–112 have negative potential $V_{C2}$ applied at the same time.

In operation of the cathode 16, as the target it is scanned by the electron beam, scanning signal are applied on terminal 139 to the shift register 135. For instance, if the scanning is from the top to the bottom of target 14, the scanning signals applied to shift register 135 are shifted first into the two stages of the shift register 135 corresponding to segments 81 and 82, applying negative potential $V_{C2}$ to segments 81 and 82, causing electron emission from the filament wires 71 in front of segments 81 and 82 of interdigited electrode 67. The electron emission then passes through the selectively switched control plates 25–30 to excite the selected portion of the target 14. As the target 14 is scanned from the top down the scanning signal is shifted down the stages of the shift register 135 apply negative potential $V_{C2}$ to the segments where emission is desired and apply negative potential $V_{C3}$ to the segments where no emission is desired as shown in FIGS. 7 and 8.

This allows a solid metal buffer plate 20 to be used allowing better terminal conditions of heat to the ambient. Also since the switched electrodes never collect any current and have low capacities MOS drive circuitry can be used.

The desired voltages $V_{C1}$, $V_{C2}$ and $V_{C3}$ are as follows:

| | |
|---|---|
| $V_{C1}$ +6 to +48 volts | |
| $V_{C2}$ −2 to −12 volts | with respect to the filament voltage reference |
| $V_{C3}$ −30 to −60 volts | |

What is claimed is:

1. A charged particle beam scanning device comprising:

an area source of charged particles for providing a uniform flow of charged particles over a predetermined area, said area source including elongated charged particle generating means for generating charged particles, a first electrode having a negative potential positioned behind said generating means, and a second electrode having a positive potential interdigitated with said first electrode, said first electrode divided into a plurality of segments, an area target, a plurality of control plates sandwiched between said source and said target for controlling the flow of charged particles therebetween, each of said control plates having a plurality of apertures formed therein, corresponding apertures of said control plates being aligned to form charged particles beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said charged particles through selected control plate apertures, and means for providing a cutoff potential to the remaining electrodes of said control plates, whereby a beam of charged particles is focused by said focusing potentials through the channels formed by said selected apertures.

2. The charged particle beam scanning device claimed in claim 1 wherein said elongated particle generating means in said area source is an elongated filament.

3. The charged particle beam scanning device claimed in claim 2 wherein said area source of charged particles includes a flat plate on which said first and second interdigitated electrodes are positioned.

4. The charged particle beam scanning device claimed in claim 3, wherein the filament means in the area source of charged particles includes a plurality of filament wires.

5. The charged particle beam scanning device claimed in claim 4 including a power source connected to said filament means for generating electrons from said area source.

6. The charged particle beam scanning device claimed in claim 1, wherein said electrodes are arranged in a binary coded finger pattern.

7. The charged particle beam scanning device claimed in claim 6, wherein each finger of said first electrode is divided into a plurality of segment insulated from each other and means are provided for interconnecting corresponding segments of each finger perpendicular to said filament wires.

8. The charged particle beam scanning device claimed in claim 7 including means for normally providing a first negative potential to said interconnected segments of said first electrode to cut off emission from that portion of the filament in front of that segment having said first negative potential applied thereto, and for selectively providing a second negative potential to said interconnected segment to cause emission from that portion of the filament in front of that segment having said second negative potential applied thereto.

9. The charged particle beam scanning device claimed in claim 8, wherein said first negative potential is more negative than second negative potential.

10. The charged particle beam scanning device claimed in claim 9 including means for selectively providing said second negative potential to said interconnected segment of said first electrode to cause selective emission of electrons from said area source of charged particles.

11. The charged particle beam scanning device claimed in claim 6, wherein said control plates comprise a dielectric substrate, said electrodes being deposited on said substrate.

12. An electron beam scanning device comprising:

an electron flood gun for providing a uniform flow of electrons over a predetermined area, said electron flood gun including a flat dish, a first electrode having a negative potential on said flat dish, a plurality of elongated filaments for generating electrons positioned in front of said first electrode, and a second electrode having a positive potential on said flat dish interdigitated with said second electrode, said first electrode divided into a plurality of segments, an area target, a plurality of control plates sandwiched between said source and said target for controlling the flow of electron therebetween, each of said control plates having a plurality of apertures formed therein, corresponding apertures of said control plates being aligned to form electron beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said electrons through selected control plate apertures, and means for providing a cutoff potential to the remaining electrodes of said control plates, whereby a beam of electrons is focused by said focusing potentials through the channels formed by said selected apertures.

13. An electron beam scanning device comprising:

an electron flood gun for providing a uniform flow of electrons over a predetermined area, said electron flood gun including a flat plate, a first electrode positioned on said flat plate, said first electrode formed in a series of elongated parallel fingers, a second electrode positioned on said flat plate insulated from said first electrode, said second electrode formed in a series of parallel fingers interdigitated with said first electrode, a plurality of elongated filaments for generating electrons, positioned in front of each finger of said first electrode, said first electrode divided into a plurality of segments, means for applying a negative potential to each of the fingers of said first electrode and a positive potential each finger of said second electrode, an area target, a plurality of control plates sandwiched between said source and said target for controlling the flow of electrons therebetween, each of said control plates having a plurality of apertures formed therein, corresponding apertures of said control plates being aligned to form electron beam channels between the source and the target, said control plates each having a plurality of electrodes on at least one of the surfaces thereof, said electrodes on each of said surfaces being electrically insulated from each other, means for providing potentials to at least one of the electrodes of each successive control plate to focus said electrons through selected control plate apertures, and means for providing a cutoff potential to the remaining electrodes of said control plates, whereby a beam of electrons is focused by said focusing potentials through the channels formed by said selected apertures.

* * * * *